US012208934B1

(12) United States Patent
Lambrechts et al.

(10) Patent No.: US 12,208,934 B1
(45) Date of Patent: Jan. 28, 2025

(54) HANDLING ITEMS FOR CUSTOM-SIZED MULTI-ITEM PACKAGES

(71) Applicant: Amazon Technologies, Inc., Seattle, WA (US)

(72) Inventors: Kristof Lambrechts, Deurne (BE); Philip Corens, Hamme (BE); Peter Van Avermaet, Sint-Gillis-Waas (BE); Matthias Martens, Melsele (BE); Jonas De Bock, Melsele (BE)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 18/362,256

(22) Filed: Jul. 31, 2023

(51) Int. Cl.

| | |
|---|---|
| ***B65B 65/08*** | (2006.01) |
| ***B65B 5/02*** | (2006.01) |
| ***B65B 5/06*** | (2006.01) |
| ***B65B 65/00*** | (2006.01) |

(52) U.S. Cl.
CPC ..... *B65B 5/024* (2013.01); *B65B 5/06* (2013.01); *B65B 65/003* (2013.01); *B65B 65/08* (2013.01)

(58) Field of Classification Search
USPC ..... 53/64
See application file for complete search history.

(56) References Cited

U.S. PATENT DOCUMENTS

| | | | | |
|---|---|---|---|---|
| 5,515,664 | A * | 5/1996 | Tanaka | B65B 5/106 53/247 |
| 2013/0000252 | A1* | 1/2013 | Pettersson | B65B 5/024 348/46 |
| 2015/0360801 | A1* | 12/2015 | Sytema | B65B 49/16 53/74 |
| 2017/0081067 | A1* | 3/2017 | Aze | B65B 57/12 |

* cited by examiner

*Primary Examiner* — Chinyere J Rushing-Tucker
(74) *Attorney, Agent, or Firm* — Eversheds Sutherland (US) LLP

(57) ABSTRACT

Systems and methods are disclosed for handling items for custom-sized multi-item packages. In one embodiment, an example system may include a multi-item loading component configured to support multiple items, the multi-item loading component including a first surface, a second surface disposed at an angle with respect to the first surface, a first sidewall configured to slide in a vertical direction from a raised position to a lowered position, and a second sidewall configured to slide in the vertical direction from the raised position to the lowered position. The system may include a pusher component configured to push the plurality of items off the multi-item loading component when the first sidewall and the second sidewall are in the lowered position.

20 Claims, 9 Drawing Sheets

HANDLING ITEMS FOR CUSTOM-SIZED MULTI-ITEM PACKAGES

BACKGROUND

As users increasingly make online purchases, fulfilment of such purchases and other orders may become increasingly complicated. For example, a fulfillment center may have output of upwards of one million packages per day. With such demands, efficiency of logistics related to processing orders and packages may be important. Accordingly, improvements in various operations of order fulfillment, such as improvements to picking technology, sorting technology, packing technology, and so forth may be desired, such that manual efforts can be redirected to different tasks. Moreover, in some instances, single items may be packed in containers for shipment. However, such items may be of different shapes and sizes. Accordingly, custom sized containers for shipping may be desired.

Figure 1:
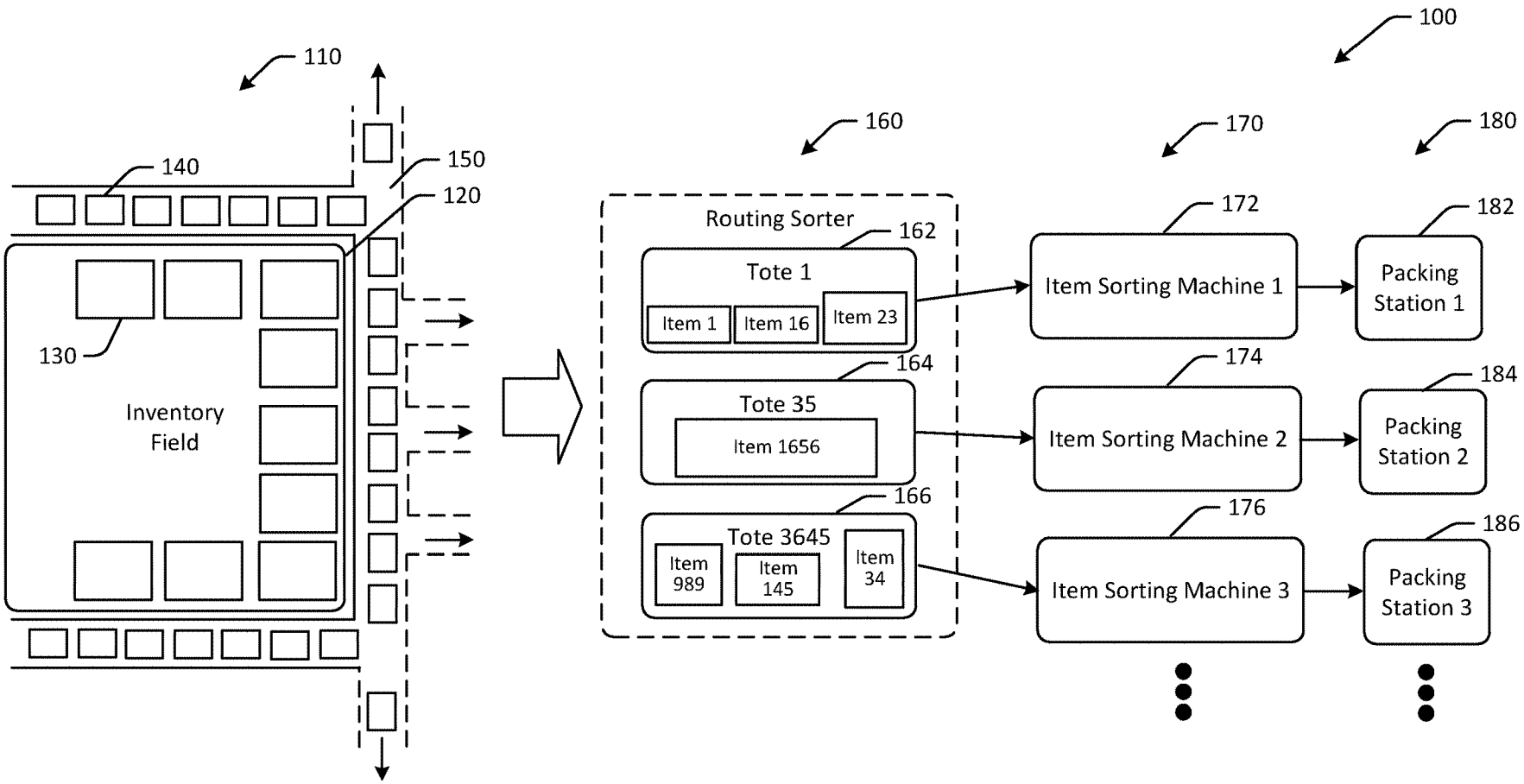
FIG. 1 is a hybrid schematic illustration of an example use case for handling items for custom-sized multi-item packages and an example process flow in accordance with one or more embodiments of the disclosure.

The detailed description is set forth with reference to the accompanying drawings. The drawings are provided for purposes of illustration only and merely depict example embodiments of the disclosure. The drawings are provided to facilitate understanding of the disclosure and shall not be deemed to limit the breadth, scope, or applicability of the disclosure. The use of the same reference numerals indicates similar, but not necessarily the same or identical components. Different reference numerals may be used to identify similar components. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

Overview

Fulfillment centers may be used to fulfill online purchases and other orders. For example, fulfillment centers may include product inventory that may be pulled when an order for a particular product or multiple products is placed. In some instances, the product(s) may be packed and shipped from the fulfillment center. However, the process of obtaining the product(s), packing the product(s), and shipping the product(s) may be complicated due to the amount of inventory, the number of orders to process, the size of the fulfillment center, and/or other factors. In addition, a portion of the fulfillment center designated for packing or shipping may be different than the portion of the fulfillment center designated for holding product inventory. As a result, transportation of products in an order may be time consuming. In addition, a number of different types of containers may be used to pack items into for shipping. For example, container types may include boxes, bags, flexible containers (e.g., paper mailers, bubble wrap mailers, etc.) and/or other types of containers. Some containers may be have fixed sizes or dimensions, and may therefore be larger than an item that is packed inside, resulting in the use of bubbles, packing paper, or other fillers to reduce a likelihood of damage to the item during transit. In addition, certain containers may be formed of non-recyclable materials, such as certain types of plastic. Accordingly, custom sized or right-sized containers that are made of recyclable or other materials may be desired so as to not only reduce environmental impact, but also to reduce waste and packaging material consumption due to custom sized containers for items, thereby removing the need for fillers and avoiding containers that are too big relative to the size of the item(s) in the container.

For packages with multiple items, such as two or more items, creating right-sized or custom-sized packages may be difficult due to placement of the items when determining package size and/or when forming a custom-sized package for the items. Such item arrangement may be performed with manual input. However, even with manual input, limitations of package formation equipment, movement of items during packing, and/or other issues may complicate the process. In contrast, forming custom-sized packages for individual items may be relatively easier and may not require any manual input.

Embodiments of the disclosure include systems and methods for providing handling items for custom-sized multi-item packages. Using multi-item loading components, more than one item can be loaded into a custom-sized package generation system for packing into an individual package. Multi-item loading components may have a V-shaped arrangement that provides an extra dimension to properly manage a wide variety of product sizes, geometrics, packing materials, etc. The V-shaped configuration may increase stability and cause settling of items in a natural manner into the XYZ-coordinates of the custom-sized package material. Embodiments may be configured to handle multi-item orders regardless of items being placed on top of each other. Some embodiments include a pusher mechanism configured to push more than one item at a time, and to match speed between moving items and corresponding packaging material, such as cardboard, so as to avoid issues due to slipping items and/or loss of control of items to be packed. Accordingly, waste in the form of oversized packaging can be reduced, and throughput can be increased due to increased compliance with automated packing equipment restrictions.

Embodiments of the disclosure can be used with any suitable type of custom-sized package, such as roll-formed containers for shipping that may improve packing quality (e.g., items may not move within the container as the container is custom sized around the item, etc.), and reduce environmental impact by providing a recyclable package that can be recycled after delivery. Some embodiments may produce roll-formed containers to ship items without waste or scrap, providing environmental benefits. Certain embodiments include custom container formation equipment that can be used to produce containers that are sized based at least in part on dimensions of an item to be packed inside the container. The containers may be formed of a single sheet of roll-formed material, such as a fiber-based material, at least partially fiber-based material, a paper-based material (e.g., unpadded cardboard, single-sided or double-sided corrugate, a non-Gaussian material, etc.) that is formed around the item to be packed. Containers may be output at a rate of up to or greater than 2,000 units per hour. Some embodiments include camera assemblies or other sensor assemblies that can be used to determine item dimensions and placement. To facilitate scalability, certain embodiments may produce a number of containers at substantially the same time, or during an overlapping timeframe. Some embodiments include optimized process flows for processing of orders at fulfillment centers, as well as process flows or methods to increase speed of consolidating products in a single-item or multi-item order as a result of improved speed in placing items into containers and removing items from containers. As a result, throughput of fulfillment centers may be improved, and/or logistics of fulfillment center operations may be less complicated.

As a result of the improve functionality provided by the systems and methods described herein, throughput of the processing of items at the fulfillment center may be increased. Some embodiments include optimized process flows for processing of orders at fulfillment centers, as well as process flows or methods to increase speed of consolidating products in a multi-item order as a result of improved speed in transportation of items and/or containers. As a result, throughput of fulfillment centers may be improved, and/or logistics of fulfillment center operations may be less complicated.

Referring to FIG. 1, an example use case 100 for handling items for custom-sized multi-item packages and an example process flow in accordance with one or more embodiments of the disclosure. Although discussed in the context of online orders, other embodiments may be directed to any suitable use case where objects are packed into containers, such as instances where items for single item orders that are picked from inventory and placed into flexible containers for shipment, and so forth.

In FIG. 1, a fulfillment center may include an inventory field 110, a routing sorter 160, one or more item sorting machines 170, and one or more packing stations 180. The inventory field 110 may be include a storage platform, or a portion of the fulfillment center at which products picked from product inventory are placed. Robots may be used to pick products from inventory and to deliver to the robotic storage platform in some instances, while in other instances, manual labor or a combination thereof may be used to pick products. The picking process at the robotic storage platform may include locating a product in an order, obtaining the product, and sending the product to a robotic storage platform, such as via a conveyor belt. In the illustrated embodiment, products at the robotic storage platform may be placed in a container, such as a tote.

The inventory field 110 may include multiple items that are in inventory. The items may be used to fulfill orders. The inventory field 110 may be a robotic field in some instances. One or more picking stations 130 may be positioned along a perimeter 120 of the inventory field 110. The picking stations 130 may be manually operated or may include robotic components, or a combination thereof. In some instances, picking of items from the inventory field 110 may be completed by robots, where the items are delivered to the picking stations 130 after being retrieved from the inventory field 110. Any number of picking stations 130 may be included, and the picking stations 130 may be located in a different position than that illustrated in FIG. 1.

One or more conveyors 150 may be disposed about the inventory field 110. For example, conveyors 150 may be disposed along the perimeter 120 of the inventory field 110. The conveyors 150 may run adjacent to the picking stations 130 in some embodiments. Any suitable conveyor configuration may be used. In the illustrated example, the conveyors 150 may include belts or rollers that run alongside the picking stations 130 and include one or more paths to one or more routing sorters.

The conveyors 150 may be used to transport one or more totes 140. For example, as totes 140 move along the conveyors 150, items may be moved from the picking stations 130 into respective totes 140. The totes 140 may be associated with particular item sorting machines, and may be moved using the conveyors 150 to a routing sorter 160.

The routing sorter 160 may be configured to route, divert, or otherwise guide certain totes to an item sorting machine. The routing sorter 160 may include any combination of ramps, slides, rollers, arms, guides, and/or other components to route totes to a particular item sorting machine. At the routing sorter 160, totes including products that have been picked may be routed to the appropriate or designated item sorting machine. For example, the routing sorter 160 may determine an identifier associated with the tote, and may determine an item sorting machine associated with the tote using the identifier. The routing sorter 160 may route or direct the tote to the appropriate item sorting machine.

A number of item sorting machines 170 may be coupled to the routing sorter 160. For example, a first item sorting machine 172, a second item sorting machine 174, a third item sorting machine 176, and so forth may be coupled to the routing sorter 160. The routing sorter 160 may guide totes to the item sorting machines to which they are assigned. For example, a first tote 162 may include item 1, item 16, and item 23, and may be assigned to the first item sorting machine 172. The routing sorter 160 may therefore route the first tote 162 to the first item sorting machine 172 for sortation of the respective items. A second tote 164 may include item 1656, and may be assigned to the second item sorting machine 174. The routing sorter 160 may therefore route the second tote 164 to the second item sorting machine 174 for sortation of the item. A third tote 166 may include item 989, item 145, and item 34, and may be assigned to the third item sorting machine 176. The routing sorter 160 may therefore route the third tote 166 to the third item sorting machine 176 for sortation of the respective items.

Some or all of the item sorting machines may be associated with one or more packing stations 180 that may be used to pack items into a shipment when a single-item or multi-item order is complete. For example, the first item sorting machine 172 may be coupled to a first packing station 182, the second item sorting machine 174 may be coupled to a second packing station 184, the third item sorting machine 176 may be coupled to a third packing station 186, and so forth. The item sorting machines may be configured to receive items from totes that have one or more, or multiple, items. The number of totes and/or the number of items associated with respective item sorting machines may be balanced, and multiple totes may be routed to the first item sorting machine 172 and the second item sorting machine 174 at the same time.

Some of the packing stations may be configured to pack items for single-item orders into containers for shipment, such as custom-sized containers, instead of pre-sized containers with fixed dimensions. In one example embodiment, container systems as described herein may be packing stations for multi-item orders, such that multiple items are placed into custom sized containers and transported downstream for shipment.

At any of the stages of the example fulfillment process of FIG. 1 where handling of objects is used, such as to pick items from inventory, place items in totes, remove items from totes, place items into bins, remove items from bins, place items into boxes for shipping, and so forth, robotic manipulators may be used. As a result, manual effort can be redirected to other tasks.

Embodiments of the disclosure include custom-sized containers, such as roll-formed containers, for shipping. Certain embodiments may reduce waste and improve shipment quality by providing custom sized containers, and may improve processing speed and/or throughput of fulfillment centers. Certain embodiments may improve performance of mechanical equipment for packing, sortation, and/or consolidation of items. While described in the context of online orders, aspects of this disclosure are more broadly applicable to other forms of object handling.

Example embodiments of the disclosure provide a number of technical features or technical effects. For example, in accordance with example embodiments of the disclosure, certain embodiments of the disclosure may improve packing quality, reduce a likelihood of item or container damage, and improve processing speed, throughput, and/or efficiency of fulfillment centers. The above examples of technical features and/or technical effects of example embodiments of the disclosure are merely illustrative and not exhaustive.

One or more illustrative embodiments of the disclosure have been described above. The above-described embodiments are merely illustrative of the scope of this disclosure and are not intended to be limiting in any way. Accordingly, variations, modifications, and equivalents of the embodiments disclosed herein are also within the scope of this disclosure. The above-described embodiments and additional and/or alternative embodiments of the disclosure will be described in detail hereinafter through reference to the accompanying drawings.

Illustrative Embodiments and Use Cases

Figure 2A:
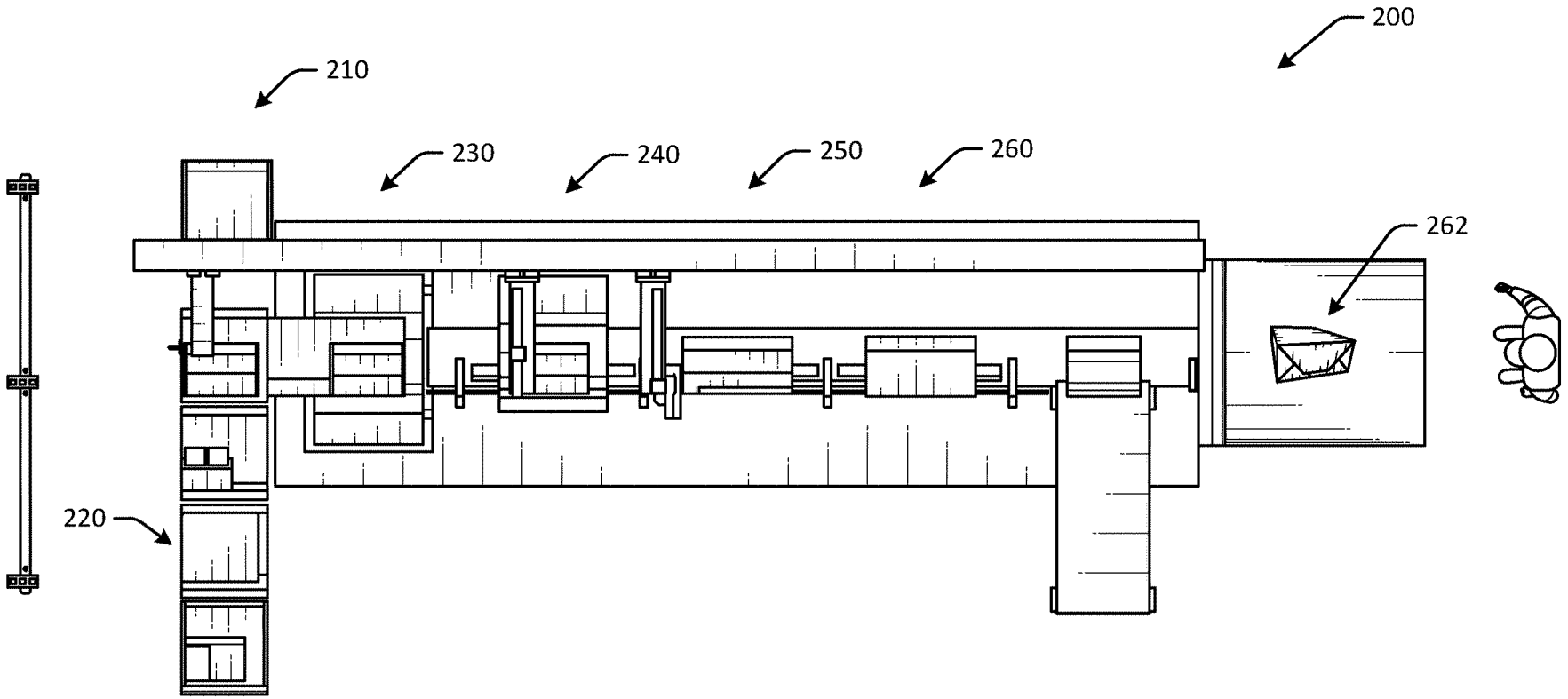
FIGS. 2A-2C are schematic illustrations of an example custom container generation system in various views in accordance with one or more embodiments of the disclosure.
Figure 2B:
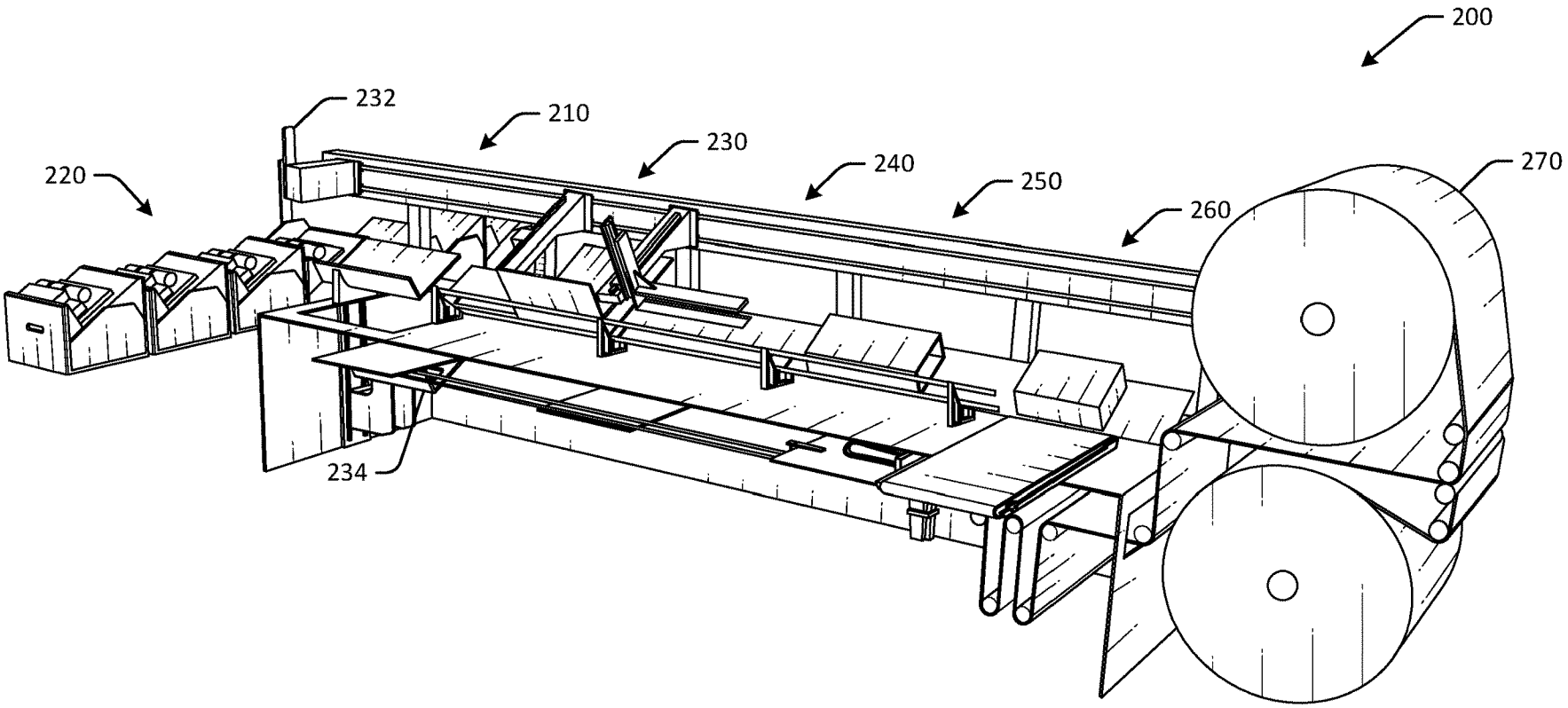
Figure 2C:
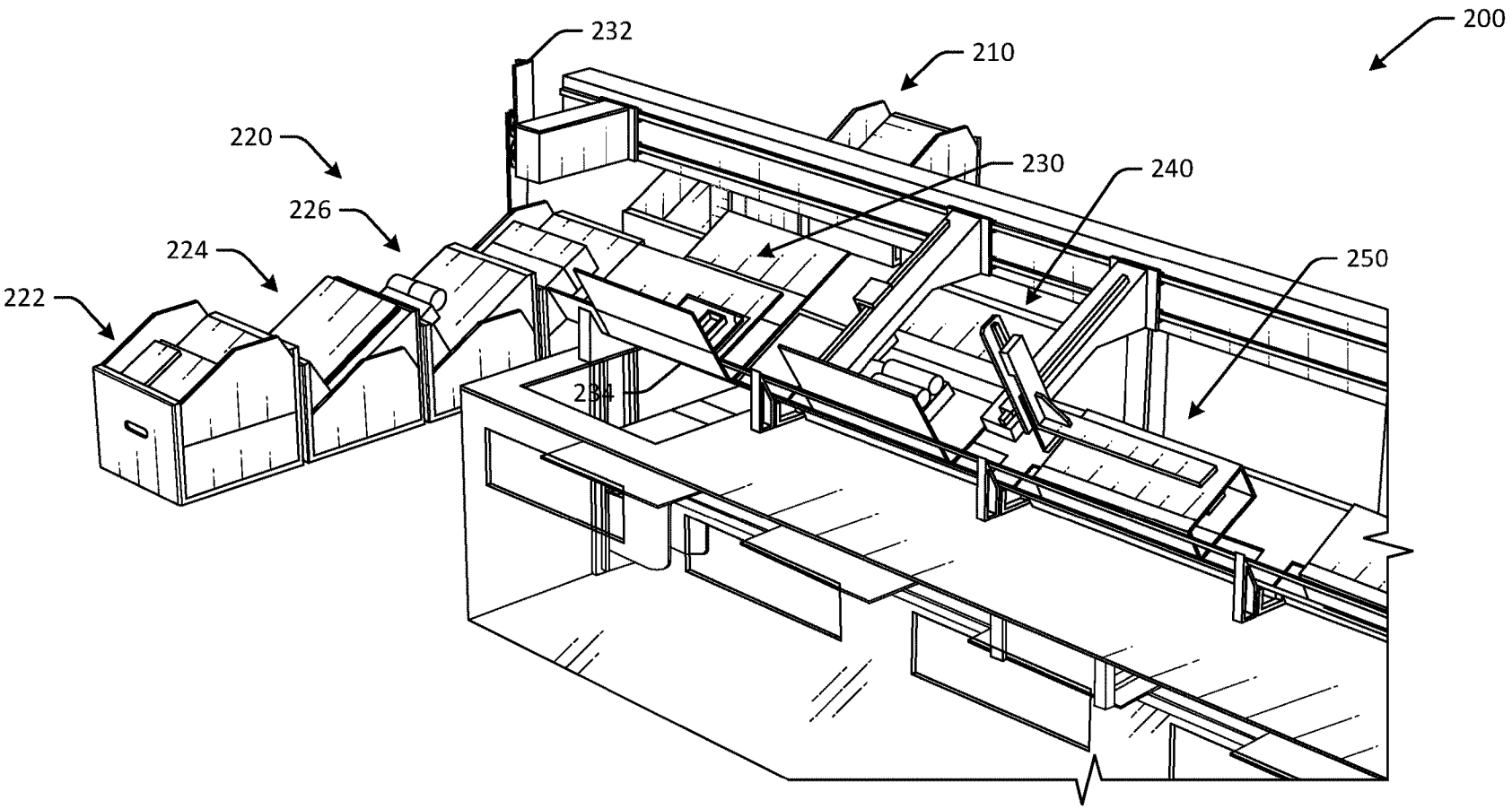

FIGS. 2A-2C are schematic illustrations of an example custom container generation system in various views in accordance with one or more embodiments of the disclosure. Other embodiments may include additional or fewer components. The illustrations of FIGS. 2A-2C may not be to scale, and may not be illustrated to scale with respect to other figures. The custom container generation system 200 illustrated in FIGS. 2A-2C is for illustrative purposes only, and other embodiments may have a different configuration. The custom container generation system 200 may be used at, for example, any of the packing stations discussed with respect to FIG. 1.

In FIG. 2A, a custom container generation system 200 is depicted in top view, and in perspective view in FIG. 2B. The custom container generation system 200 may be configured to generate custom-sized packages for multi-item orders, such that individual packages have multiple items therein. The custom container generation system 200 may include a conveyor 210 at a front end of the custom container generation system 200, where items for packing may be ingested into the custom container generation system 200. The conveyor 210 may be configured to convey individual multi-item loading components 220 to an intake gutter portion 230 of the custom container generation system 200. For example, as depicted in FIG. 2C, the conveyor 210 may be configured to move a first multi-item loading component 226 to a position adjacent to the intake gutter portion 230 of the custom-sized package generation system 200, and then a second multi-item loading component 224, a third multi-item loading component 226, and so forth. Empty multi-item loading components may be reloaded with multiple items.

The multi-item loading component 220 may be configured to support the items for a particular multiple item order on a V-shaped surface. The items may be pushed off the multi-item loading component 220 and onto the intake gutter portion 230 using an automated pusher component, as discussed at least with respect to FIGS. 3-4. When the multi-item loading component 220 is emptied, the empty multi-item loading component 220 may be conveyed downstream via conveyor 210 and another multi-item loading component 220 may be emptied into the custom container generation system 200.

In some embodiments, an overhead sensor may be configured to image the multiple items or a plurality of items on a multi-item loading component 220. The image may be used by a controller or computer system to determine dimensions for the custom-sized package to be generated for the items. In some instances, the images may be used to determine whether the items are positioned correctly, and/or whether any adjustments need to be made. For example, the custom-sized package generation system 200 may include an optional display, and the controller may be configured to determine that the plurality of items is out of position or is not within a predefined space on the multi-item loading component 220, and may cause presentation of a manual handling notification at the display. In another example, the controller may determine a set of available package sizes that the custom-sized package generation system 200 can produce, and select a package size from the set of available package sizes to be generated by the custom-sized package generation system 200 (which may be at least partially based at least in part on the image). One or more sensors, such as infrared LEDs, light arrays, cameras, and/or other sensors, may be used to determine various dimensions of the items, such as a combined height, a combined width, and/or a combined length of the item. In some embodiments, based on the dimensions of the items, the custom container generation system 200 may determine whether a container can be formed for the items. For example, if the items have a height that exceeds a threshold, the custom container generation system 200 may be unable to produce a container for the item. Accordingly, such items may be ejected from the custom container generation system 200. For example, ejected items may be pushed using an arm or conveyed using a conveyor onto an ejected item portion of the custom container generation system 200. During the induction process, one or more cameras or other sensors, such as LIDAR sensors, depth sensors, infrared LEDs, and so forth may be used to determine one or more dimensions of the items. For example, a first sensor may be used to capture one or more top-down images of the items, and a second sensor may be used to capture one or more side-view images or dimensions of the items. The sensor(s) may generate data that is used to determine one or more dimensions of the items. For example, the sensor(s) may be depth cameras or depth sensors used to generate data points that can be processed to determine one or more dimensions of the items.

The custom-sized package generation system 200 may include a pusher component 232 configured to push the plurality of items off the multi-item loading component 220. In order to allow items to be pushed off the multi-item loading component 220, the sidewalls of the multi-item loading component may be lowered, as discussed with respect to at least FIG. 4. When the first sidewall and the second sidewall are in the lowered position, the items may be pushed off.

At the intake gutter portion 230 of the custom-sized package generation system 200, a lifter component 234 may be configured to lift a sheet of packaging material (which may be dispensed from one or more spools 270), such as cardboard or other material, toward the intake gutter portion 230. The lifter component 234 may be configured to form the sheet of packaging material around the intake gutter portion 230. In some embodiments, the intake gutter portion 230 may have a V-shaped configuration that matches the V-shaped configuration of the multi-item loading component 220. For example, the V-shaped configuration may have the same angle between surfaces as the multi-item component 220. The lifter component 234 may be configured to move the sheet of packaging material laterally at a substantially same speed as the pusher component 232 pushes the plurality of items. As a result of the speed match, the multiple items may remain under control without slippage. For lateral movement of the packaging material, the lifter component 234 may optionally include a belt configured to move the packaging material downstream. In some embodiments, the lifter component 234 may include a suction portion configured to secure the sheet of packaging material to the lifter component 234. During operation, the lifter component 234 may lift the packaging material while the packaging material has a flat configuration, and then the lifter component 234 may form or press the packaging material about the V-shaped intake gutter portion to fold the packaging material. In some instances, the lifter component 234 may have a high friction surface instead of, or in addition to, suction lines to secure the packaging material to the lifter component 234 during vertical motion.

Items may be pushed off the intake gutter portion 230 and onto the packaging material at a transfer portion 240 of the custom-sized package generation system 200. The packaging material may be accelerated to a same speed as the pusher component 232, so as to avoid movement amongst the multiple items. The packaging material may be folded about the multiple items at a folding portion 250 of the custom-sized package generation system 200. The package may be sealed at a sealing portion 260 of the custom-sized package generation system 200. Ends of the packaging material may be caused to be sealed to form a package, where the first item is disposed in the package. One or more compress bars or other equipment may be caused, by the controller, to add pressure to the ends and/or the overlapping portion of the packaging material to seal the package. The remaining portion of the packaging material may be cut and the sealed package may be transferred for downstream processing. Sealing may include sewing, pressing, folding, or otherwise closing the package. A custom-sized package 262 may be output by the custom-sized package generation system 200 and may include multiple items therein.

The controller may determine, using the controller, a length of packaging material to use for packing the items based at least in part on the measured dimensions. For example, based at least in part on a length of the items, a length of packaging material may be determined that corresponds to the length of the items. In another example, the width or height of the items may be used to determine the length of packaging material. The determined length may be used to determine how much packaging material is to be unrolled or otherwise used to package the items. For example, the controller may cause the packaging material to advance from a roll of packaging material until the length of packaging material to use for packing the item is advanced.

Figure 3:
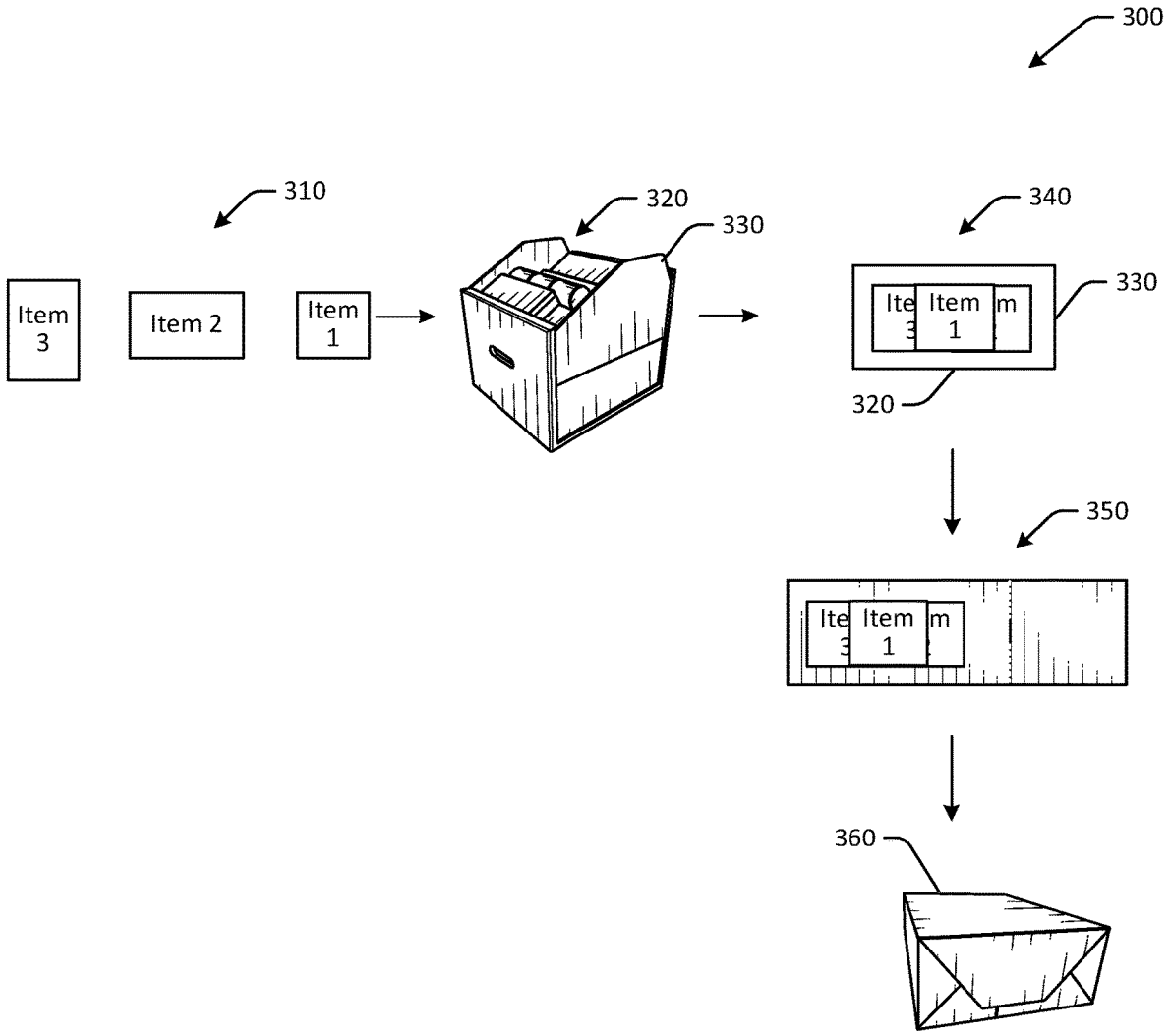
FIG. 3 is a schematic illustration of an example multi-item packing process in accordance with one or more embodiments of the disclosure.

FIG. 3 is a schematic illustration of an example multi-item packing process in accordance with one or more embodiments of the disclosure. Other embodiments may include additional or fewer components. The illustration of FIG. 3 may not be to scale, and may not be illustrated to scale with respect to other figures. The components illustrated in FIG. 3 are for illustrative purposes only, and other embodiments may have a different configuration. The components illustrated in FIG. 3 may be the same as some of the components discussed with respect to FIGS. 1-2C.

Figure 7:
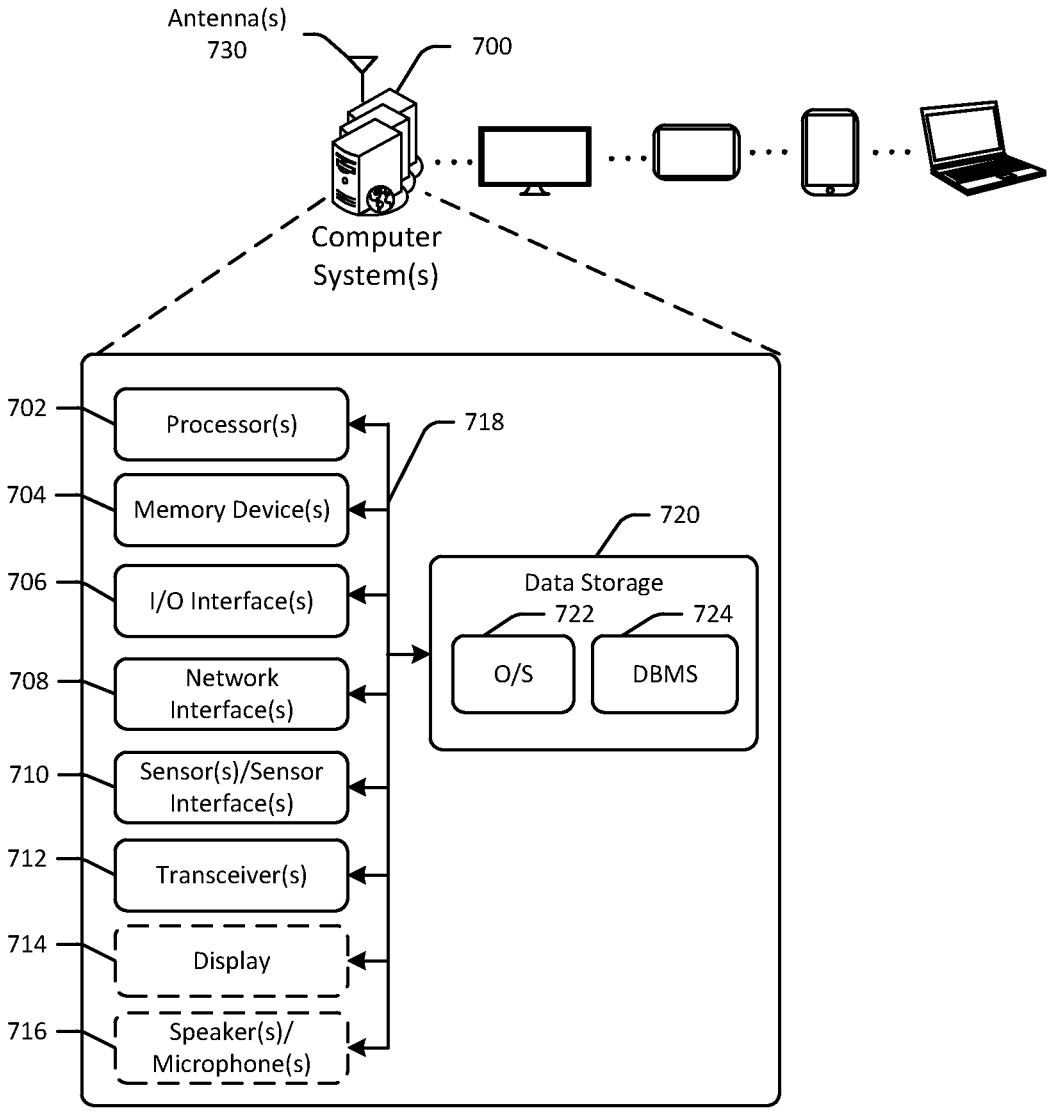
FIG. 7 schematically illustrates an example architecture of a computer system associated with a custom container generation system in accordance with one or more embodiments of the disclosure.

In FIG. 3, an example flow 300 of items for packing into a multi-item package is depicted. Items 310 for the multi-item order may be aggregated and may include Item 1, Item 2, and Item 3. The items may be dimensioned using a measurement device 340, such as one or more sensors, e.g., a 3D scanner, a camera, and/or another type of device. Based at least in part on sizes of the items, a controller (e.g., as depicted in FIG. 7) may determine a corresponding package size for a custom-sized package in which to place the items 310. Based at least in part on the package size, the controller may determine an item arrangement for the items 310. For example, Item 1 may be placed on top of Item 2 and Item 3. Other arrangements may be possible and may be determined based at least in part on the package size. The items may be loaded or placed onto a multi-item loading component 320 that includes one or more sliding sidewalls 330. In some embodiments, the imaging of the items may be completed after the items have been placed onto the multi-item loading component 320. The items 310 may be unloaded from the multi-item loading component 320 by pushing the items off the multi-item loading component 320 when the sliding sidewalls 330 are lowered. The items 310 may be pushed onto a sheet of packaging material 350. The sheet of packaging material 350 may be folded about the items 310 and sealed to form a custom-sized package 360.

In some embodiments, a process flow may be executed by a local or remote controller of a custom-sized package generation system or a connected computer system. The package generation system may include memory having computer-executable instructions, and one or more computer processors configured to access the memory and execute the computer-executable instructions to perform one or more operations. In some embodiments, the system may include a multi-item loading component having one or more moveable sidewalls. The controller may determine a size of the items to be placed in the custom-sized package. For example, the controller may use one or more sensors, such as the measurement device and/or other devices to determine one or more dimensions of the items, such as length, height, width, weight, or another dimension. In some embodiments, size data may be determined by identifying the item via a barcode or other identifier and retrieving information from a database.

In some embodiments, based at least in part on the item sizes, the controller may determine a set of available package sizes for packages that can be formed by the custom-sized package generator, and may select a package size from the set of available package sizes to be generated by the packing system based at least in part on the first size and the second size.

Figure 4:
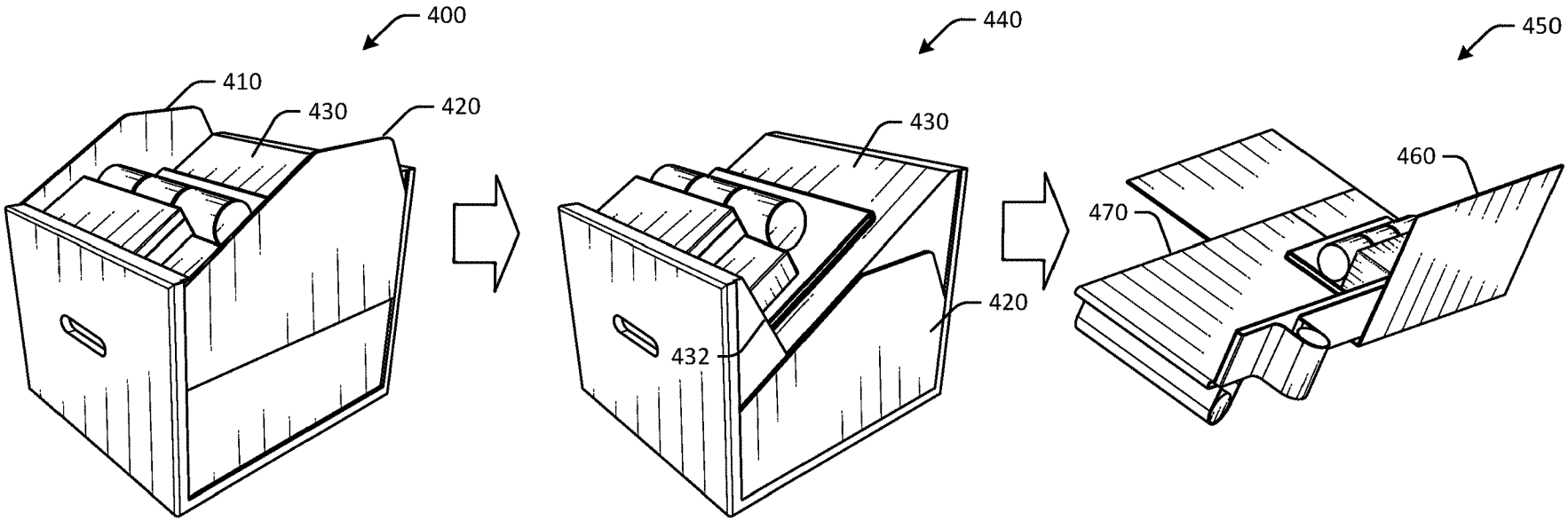
FIG. 4 is a schematic illustration of an example multi-item loading component in various configurations in accordance with one or more embodiments of the disclosure.

FIG. 4 is a schematic illustration of an example multi-item loading component 400 in various configurations in accordance with one or more embodiments of the disclosure. Other embodiments may include additional or fewer components. The illustration of FIG. 4 may not be to scale, and may not be illustrated to scale with respect to other figures. The multi-item loading component depicted in the example of FIG. 4 is for illustrative purposes only. Other embodiments may have different configurations. The components illustrated in FIG. 4 may be the same container discussed with respect to FIGS. 1-3.

In FIG. 4, the multi-item loading component 400 may include a first sliding sidewall 410 and a second sidewall 420. The first sidewall 410 and the second sidewall 420 may be configured to slide in a vertical direction. In a raised position, the first sidewall 410 and the second sidewall 420 may support the items loaded on the multi-item loading component 400 and may prevent items sliding off the multi-item loading component 400. In a lowered position 440, items may be pushed off the multi-item loading component 400 and moved downstream for packing. For example, items may be pushed onto an intake gutter portion 450 of a packing system, where the intake gutter portion 450 has a V-shaped configuration formed by a first surface 470 and a second surface 460 that form an angle the same as, or substantially the same as, the V-shaped configuration of the multi-item loading component 400.

The multi-item loading component 400 may be configured to support a plurality of items that are to be packed into a single package. The multi-item loading component 400 may include a first surface 432 and a second surface 430 that is disposed at an angle with respect to the first surface 432. In some embodiments, the angle may be an acute angle. The first surface 432 and the second surface 430 may form a V-shaped configuration. As depicted in the example of FIG. 4, the first surface 432 may have a first length that is shorter than a second length of the second surface 430. The multi-item loading component may be disposed at a front end of a custom-sized package generation system. The first sidewall 410 may be configured to slide in a vertical direction from a raised position to a lowered position, and the second sidewall 420 may be configured to slide in the vertical direction from the raised position to the lowered position. Accordingly, the multi-item loading component 400 may be used with, or may be part of, a system for generating a custom-sized package having a plurality of items.

Figure 5:
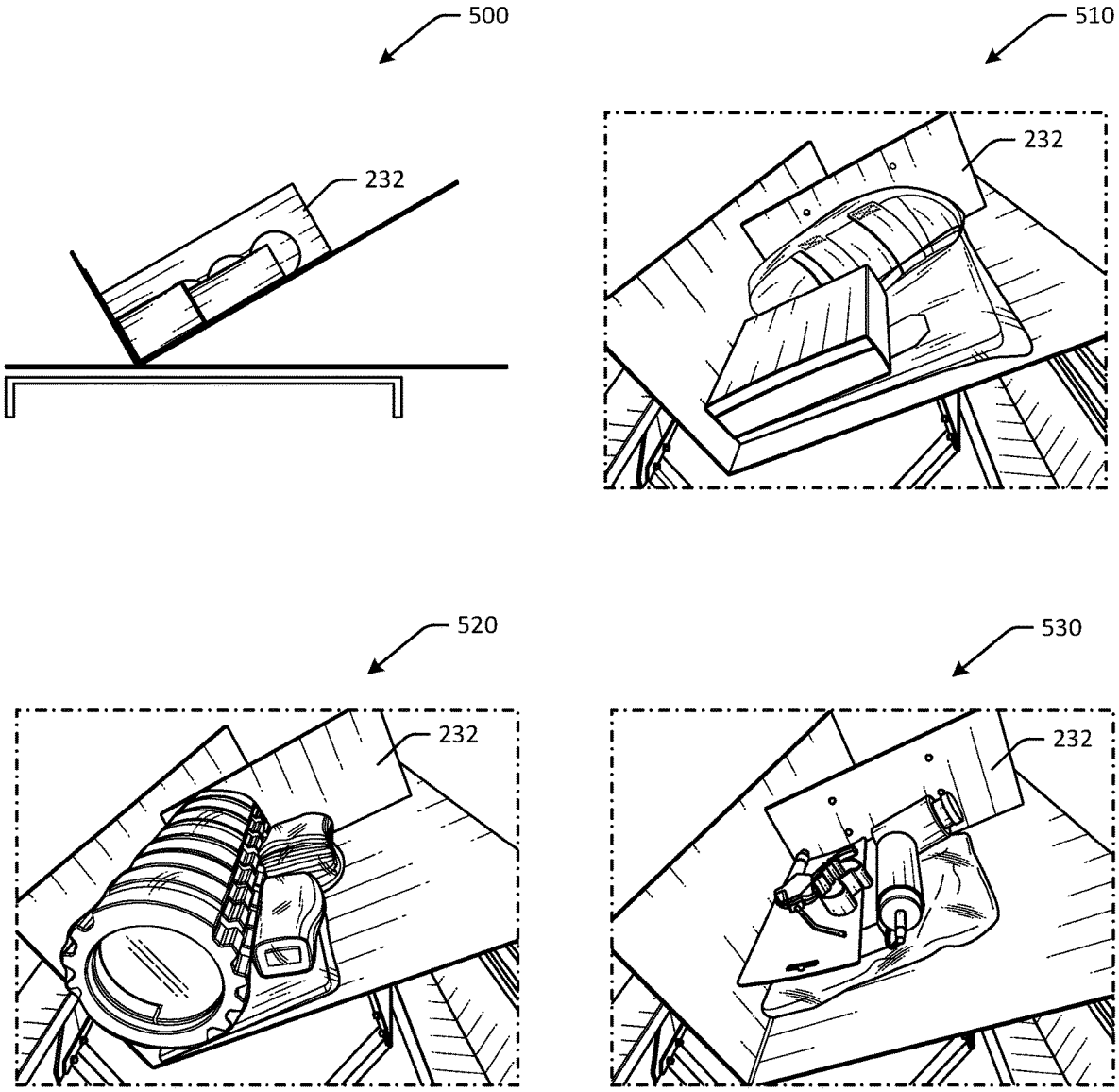
FIG. 5 is a schematic illustration of example items loaded onto a multi-item loading component in accordance with one or more embodiments of the disclosure.

FIG. 5 is a schematic illustration of example items loaded onto a multi-item loading component in accordance with one or more embodiments of the disclosure. Other embodiments may include additional or fewer components. The illustrations of FIG. 5 may not be to scale, and may not be illustrated to scale with respect to other figures. The components illustrated in FIG. 5 may be the same as some of the components discussed with respect to FIGS. 1-4.

In FIG. 5, a side view of items loaded onto a first multi-item component 500 is depicted. The plurality of items may be directed toward a lower end of the V-shaped configuration due to gravity, which may settle the items in a preferred location for pushing downstream. In some embodiments, items can be arranged or rearranged manually for optimize downstream processing. A second multi-item component 510 is depicted in perspective view. Any type of item in various types of packaging, such as sandals, books, gift cards, and so forth, can be combined and placed onto the second multi-item component 510. In another example, a third multi-item component 520 may include items such as a cylindrical foam roller with a relatively high surface friction coefficient and a lightweight flashlight having a relatively low surface friction coefficient, all of which may be pushed downstream without issue. In another example, a fourth multi-item component 530 may include items stacked on top of a low friction or slippery folder, which may not be problematic due to the pusher component 232 pushing all of the items from one end of the multi-item component.

Figure 6:
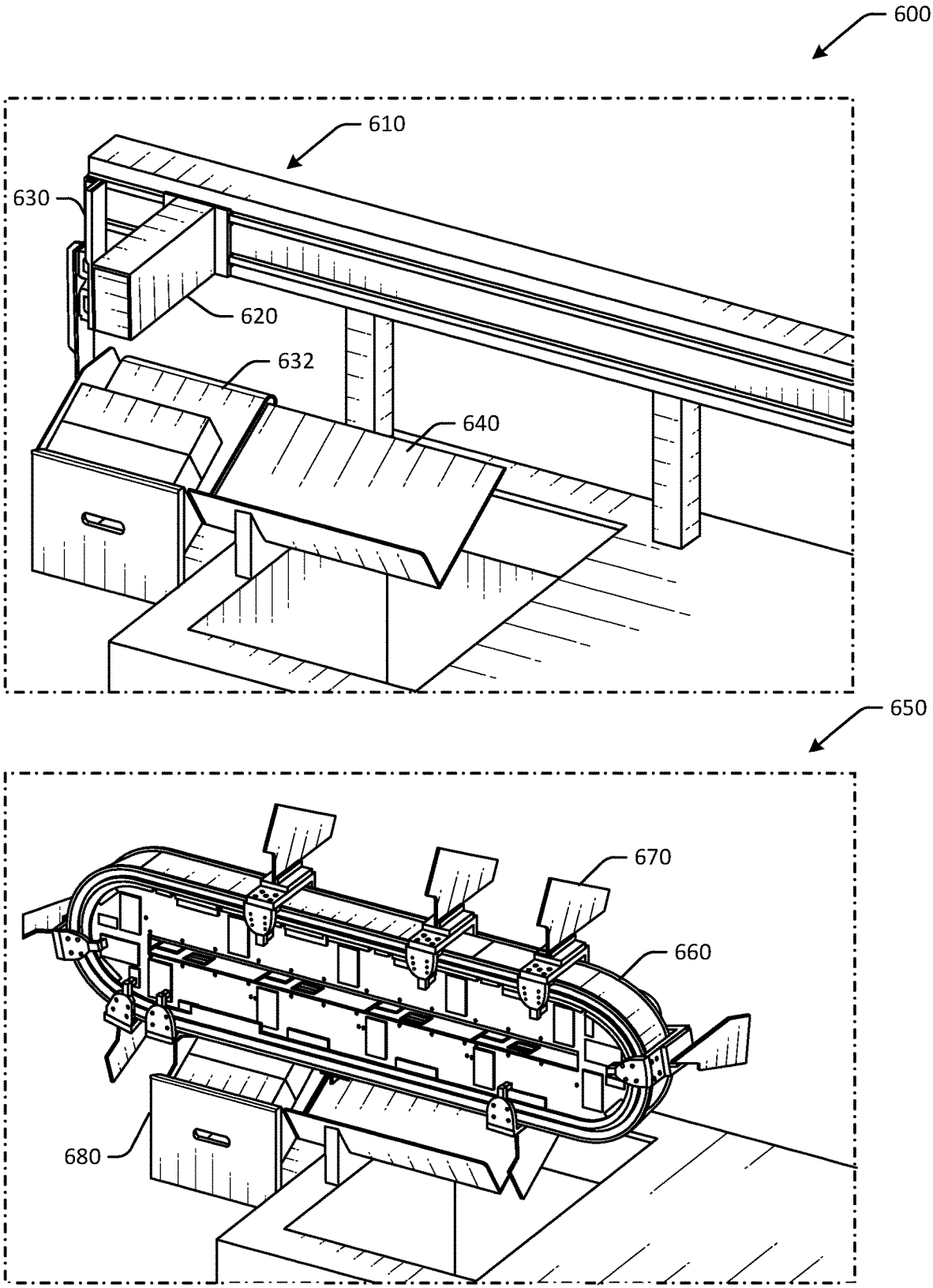
FIG. 6 is a schematic illustration of example alternate multi-item push mechanisms in accordance with one or more embodiments of the disclosure.

FIG. 6 is a schematic illustration of example alternate multi-item push mechanisms in accordance with one or more embodiments of the disclosure. Other embodiments may include additional or fewer components. The illustration of FIG. 6 may not be to scale, and may not be illustrated to scale with respect to other figures. The components illustrated in FIG. 6 may be the same as some of the components discussed with respect to FIGS. 1-5.

In FIG. 6, a first pusher mechanism 600 may be the same as the pusher component 232 discussed with respect to FIGS. 2A-2C. The first pusher mechanism 600 may include a track 610 along which a pusher 620 may slide or reciprocate. A moving portion 630 coupled to the pusher 620 may push items from a multi-item component 632 onto an intake gutter 640, and further downstream onto the sheet of packaging material. The moving portion 630 may be the pusher component 232 and may be configured to rotate with respect to the pusher 620, so as to contact the items during pushing, and then rotate upwards while the pusher 620 slides back to a default position prior to pushing another set of items.

In an alternate configuration 650, a closed loop track 660 may include one or more fins 670 that may be used to push items off multi-item components 680 in a continuous movement motion profile. In such embodiments, throughput may be increased as no change of direction may be needed to reset the pusher for a subsequent set of items. The fins 670 may have the trapezoidal configuration depicted in the example of FIG. 6 to interface with the V-shaped configuration of the multi-item components.

One or more operations of the methods, process flows, or use cases of FIGS. 1-6 may have been described above as being performed by a user device, or more specifically, by one or more program module(s), applications, or the like executing on a device. It should be appreciated, however, that any of the operations of the methods, process flows, or use cases of FIGS. 1-6 may be performed, at least in part, in a distributed manner by one or more other devices, or more specifically, by one or more program module(s), applications, or the like executing on such devices. In addition, it should be appreciated that processing performed in response to the execution of computer-executable instructions provided as part of an application, program module, or the like may be interchangeably described herein as being performed by the application or the program module itself or by a device on which the application, program module, or the like is executing. While the operations of the methods, process flows, or use cases of FIGS. 1-6 may be described in the context of the illustrative devices, it should be appreciated that such operations may be implemented in connection with numerous other device configurations.

The operations described and depicted in the illustrative methods, process flows, and use cases of FIGS. 1-6 may be carried out or performed in any suitable order, such as the depicted orders, as desired in various example embodiments of the disclosure. Additionally, in certain example embodiments, at least a portion of the operations may be carried out in parallel. Furthermore, in certain example embodiments, less, more, or different operations than those depicted in FIGS. 1-6 may be performed.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by the execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Illustrative Computer Architecture

FIG. 7 is a schematic block diagram of one or more illustrative computer system(s) 700 associated with a custom container generation system in accordance with one or more example embodiments of the disclosure. The computer system(s) 700 may include any suitable computing device including, but not limited to, a server system, a voice interaction device, a mobile device such as a smartphone, a tablet, an e-reader, a wearable device, or the like; a desktop computer; a laptop computer; a content streaming device; or the like. The computer system(s) 700 may correspond to an illustrative device configuration for the controller(s) of FIGS. 1-6. For example, the computer system(s) 700 may be a controller and may control one or more aspects of the custom container generation systems described in FIGS. 1-6.

The computer system(s) 700 may be configured to communicate with one or more servers, user devices, or the like. The computer system(s) 700 may be configured to control operation of one or more components of the custom container generation systems, such as determining loading or pusher operations, causing certain amounts of materials to be dispensed for package formation, and so forth.

The computer system(s) 700 may be configured to communicate via one or more networks. Such network(s) may include, but are not limited to, any one or more different types of communications networks such as, for example, cable networks, public networks (e.g., the Internet), private networks (e.g., frame-relay networks), wireless networks, cellular networks, telephone networks (e.g., a public switched telephone network), or any other suitable private or public packet-switched or circuit-switched networks. Further, such network(s) may have any suitable communication range associated therewith and may include, for example, global networks (e.g., the Internet), metropolitan area networks (MANs), wide area networks (WANs), local area networks (LANs), or personal area networks (PANs). In addition, such network(s) may include communication links and associated networking devices (e.g., link-layer switches, routers, etc.) for transmitting network traffic over any suitable type of medium including, but not limited to, coaxial cable, twisted-pair wire (e.g., twisted-pair copper wire), optical fiber, a hybrid fiber-coaxial (HFC) medium, a microwave medium, a radio frequency communication medium, a satellite communication medium, or any combination thereof.

In an illustrative configuration, the computer system(s) 700 may include one or more processors (processor(s)) 702, one or more memory devices 704 (also referred to herein as memory 704), one or more input/output (I/O) interface(s) 706, one or more network interface(s) 708, one or more sensor(s) or sensor interface(s) 710, one or more transceiver(s) 712, one or more optional display(s) 714, one or more optional microphone(s) 716, and data storage 720. The computer system(s) 700 may further include one or more bus(es) 718 that functionally couple various components of the computer system(s) 700. The computer system(s) 700 may further include one or more antenna(s) 730 that may include, without limitation, a cellular antenna for transmitting or receiving signals to/from a cellular network infrastructure, an antenna for transmitting or receiving Wi-Fi signals to/from an access point (AP), a Global Navigation Satellite System (GNSS) antenna for receiving GNSS signals from a GNSS satellite, a Bluetooth antenna for transmitting or receiving Bluetooth signals, a Near Field Communication (NFC) antenna for transmitting or receiving NFC signals, and so forth. These various components will be described in more detail hereinafter.

The bus(es) 718 may include at least one of a system bus, a memory bus, an address bus, or a message bus, and may permit the exchange of information (e.g., data (including computer-executable code), signaling, etc.) between various components of the computer system(s) 700. The bus(es) 718 may include, without limitation, a memory bus or a memory controller, a peripheral bus, an accelerated graphics port, and so forth. The bus(es) 718 may be associated with any suitable bus architecture including, without limitation, an Industry Standard Architecture (ISA), a Micro Channel Architecture (MCA), an Enhanced ISA (EISA), a Video Electronics Standards Association (VESA) architecture, an Accelerated Graphics Port (AGP) architecture, a Peripheral Component Interconnect (PCI) architecture, a PCI-Express architecture, a Personal Computer Memory Card International Association (PCMCIA) architecture, a Universal Serial Bus (USB) architecture, and so forth.

The memory 704 of the computer system(s) 700 may include volatile memory (memory that maintains its state when supplied with power) such as random access memory (RAM) and/or non-volatile memory (memory that maintains its state even when not supplied with power) such as read-only memory (ROM), flash memory, ferroelectric RAM (FRAM), and so forth. Persistent data storage, as that term is used herein, may include non-volatile memory. In certain example embodiments, volatile memory may enable faster read/write access than non-volatile memory. However, in certain other example embodiments, certain types of non-volatile memory (e.g., FRAM) may enable faster read/write access than certain types of volatile memory.

In various implementations, the memory 704 may include multiple different types of memory such as various types of static random access memory (SRAM), various types of dynamic random access memory (DRAM), various types of unalterable ROM, and/or writeable variants of ROM such as electrically erasable programmable read-only memory (EEPROM), flash memory, and so forth. The memory 704 may include main memory as well as various forms of cache memory such as instruction cache(s), data cache(s), translation lookaside buffer(s) (TLBs), and so forth. Further, cache memory such as a data cache may be a multi-level cache organized as a hierarchy of one or more cache levels (L1, L2, etc.).

The data storage 720 may include removable storage and/or non-removable storage including, but not limited to, magnetic storage, optical disk storage, and/or tape storage. The data storage 720 may provide non-volatile storage of computer-executable instructions and other data. The memory 704 and the data storage 720, removable and/or non-removable, are examples of computer-readable storage media (CRSM) as that term is used herein.

The data storage 720 may store computer-executable code, instructions, or the like that may be loadable into the memory 704 and executable by the processor(s) 702 to cause the processor(s) 702 to perform or initiate various operations. The data storage 720 may additionally store data that may be copied to the memory 704 for use by the processor(s) 702 during the execution of the computer-executable instructions. Moreover, output data generated as a result of execution of the computer-executable instructions by the processor(s) 702 may be stored initially in the memory 704, and may ultimately be copied to the data storage 720 for non-volatile storage.

More specifically, the data storage 720 may store one or more operating systems (O/S) 722; one or more database management systems (DBMS) 724; and one or more program module(s), applications, engines, computer-executable code, scripts, or the like. Some or all of these module(s) may be sub-module(s). Any of the components depicted as being stored in the data storage 720 may include any combination of software, firmware, and/or hardware. The software and/or firmware may include computer-executable code, instructions, or the like that may be loaded into the memory 704 for execution by one or more of the processor(s) 702. Any of the components depicted as being stored in the data storage 720 may support functionality described in reference to corresponding components named earlier in this disclosure.

The data storage 720 may further store various types of data utilized by the components of the computer system(s) 700. Any data stored in the data storage 720 may be loaded into the memory 704 for use by the processor(s) 702 in executing computer-executable code. In addition, any data depicted as being stored in the data storage 720 may potentially be stored in one or more datastore(s) and may be accessed via the DBMS 724 and loaded in the memory 704 for use by the processor(s) 702 in executing computer-executable code. The datastore(s) may include, but are not limited to, databases (e.g., relational, object-oriented, etc.), file systems, flat files, distributed datastores in which data is stored on more than one node of a computer network, peer-to-peer network datastores, or the like.

The processor(s) 702 may be configured to access the memory 704 and execute the computer-executable instructions loaded therein. For example, the processor(s) 702 may be configured to execute the computer-executable instructions of the various program module(s), applications, engines, or the like of the computer system(s) 700 to cause or facilitate various operations to be performed in accordance with one or more embodiments of the disclosure. The processor(s) 702 may include any suitable processing unit capable of accepting data as input, processing the input data in accordance with stored computer-executable instructions, and generating output data. The processor(s) 702 may include any type of suitable processing unit including, but not limited to, a central processing unit, a microprocessor, a Reduced Instruction Set Computer (RISC) microprocessor, a Complex Instruction Set Computer (CISC) microprocessor, a microcontroller, an Application Specific Integrated Circuit (ASIC), a Field-Programmable Gate Array (FPGA), a System-on-a-Chip (SoC), a digital signal processor (DSP), and so forth. Further, the processor(s) 702 may have any suitable microarchitecture design that includes any number of constituent components such as, for example, registers, multiplexers, arithmetic logic units, cache controllers for controlling read/write operations to cache memory, branch predictors, or the like. The microarchitecture design of the processor(s) 702 may be capable of supporting any of a variety of instruction sets.

Referring now to other illustrative components depicted as being stored in the data storage 720, the O/S 722 may be loaded from the data storage 720 into the memory 704 and may provide an interface between other application software executing on the computer system(s) 700 and the hardware resources of the computer system(s) 700. More specifically, the O/S 722 may include a set of computer-executable instructions for managing the hardware resources of the computer system(s) 700 and for providing common services to other application programs (e.g., managing memory allocation among various application programs). In certain example embodiments, the O/S 722 may control execution of the other program module(s). The O/S 722 may include any operating system now known or which may be developed in the future including, but not limited to, any server operating system, any mainframe operating system, or any other proprietary or non-proprietary operating system.

The DBMS 724 may be loaded into the memory 704 and may support functionality for accessing, retrieving, storing, and/or manipulating data stored in the memory 704 and/or data stored in the data storage 720. The DBMS 724 may use any of a variety of database models (e.g., relational model, object model, etc.) and may support any of a variety of query languages. The DBMS 724 may access data represented in one or more data schemas and stored in any suitable data repository including, but not limited to, databases (e.g., relational, object-oriented, etc.), file systems, flat files, distributed datastores in which data is stored on more than one node of a computer network, peer-to-peer network datastores, or the like. In those example embodiments in which the computer system(s) 700 is a mobile device, the DBMS 724 may be any suitable lightweight DBMS optimized for performance on a mobile device.

Referring now to other illustrative components of the computer system(s) 700, the input/output (I/O) interface(s) 706 may facilitate the receipt of input information by the computer system(s) 700 from one or more I/O devices as well as the output of information from the computer system(s) 700 to the one or more I/O devices. The I/O devices may include any of a variety of components such as a display or display screen having a touch surface or touchscreen; an audio output device for producing sound, such as a speaker; an audio capture device, such as a microphone; an image and/or video capture device, such as a camera; a haptic unit; and so forth. Any of these components may be integrated into the computer system(s) 700 or may be separate. The I/O devices may further include, for example, any number of peripheral devices such as data storage devices, printing devices, and so forth.

The I/O interface(s) 706 may also include an interface for an external peripheral device connection such as universal serial bus (USB), FireWire, Thunderbolt, Ethernet port or other connection protocol that may connect to one or more networks. The I/O interface(s) 706 may also include a connection to one or more of the antenna(s) 730 to connect to one or more networks via a wireless local area network (WLAN) (such as Wi-Fi) radio, Bluetooth, ZigBee, and/or a wireless network radio, such as a radio capable of communication with a wireless communication network such as a Long Term Evolution (LTE) network, WiMAX network, 3G network, a ZigBee network, etc.

The computer system(s) 700 may further include one or more network interface(s) 708 via which the computer system(s) 700 may communicate with any of a variety of other systems, platforms, networks, devices, and so forth. The network interface(s) 708 may enable communication, for example, with one or more wireless routers, one or more host servers, one or more web servers, and the like via one or more networks.

The antenna(s) 730 may include any suitable type of antenna depending, for example, on the communications protocols used to transmit or receive signals via the antenna(s) 730. Non-limiting examples of suitable antenna(s) may include directional antenna(s), non-directional antenna(s), dipole antenna(s), folded dipole antenna(s), patch antenna(s), multiple-input multiple-output (MIMO) antenna(s), or the like. The antenna(s) 730 may be communicatively coupled to one or more transceivers 712 or radio components to which or from which signals may be transmitted or received.

As previously described, the antenna(s) 730 may include a cellular antenna configured to transmit or receive signals in accordance with established standards and protocols, such as Global System for Mobile Communications (GSM), 3G standards (e.g., Universal Mobile Telecommunications System (UMTS), Wideband Code Division Multiple Access (W-CDMA), CDMA2000, etc.), 4G standards (e.g., Long-Term Evolution (LTE), WiMax, etc.), direct satellite communications, or the like.

The antenna(s) 730 may additionally, or alternatively, include a Wi-Fi antenna configured to transmit or receive signals in accordance with established standards and protocols, such as the IEEE 802.11 family of standards, including via 2.4 GHz channels (e.g., 802.11b, 802.11g. 802.11n), 5 GHz channels (e.g., 802.11n, 802.11ac), or 60 GHz channels (e.g., 802.11ad). In alternative example embodiments, the antenna(s) 730 may be configured to transmit or receive radio frequency signals within any suitable frequency range forming part of the unlicensed portion of the radio spectrum.

The antenna(s) 730 may additionally, or alternatively, include a GNSS antenna configured to receive GNSS signals from three or more GNSS satellites carrying time-position information to triangulate a position therefrom. Such a GNSS antenna may be configured to receive GNSS signals from any current or planned GNSS such as, for example, the Global Positioning System (GPS), the GLONASS System, the Compass Navigation System, the Galileo System, or the Indian Regional Navigational System.

The transceiver(s) 712 may include any suitable radio component(s) for—in cooperation with the antenna(s) 730—transmitting or receiving radio frequency (RF) signals in the bandwidth and/or channels corresponding to the communications protocols utilized by the computer system(s) 700 to communicate with other devices. The transceiver(s) 712 may include hardware, software, and/or firmware for modulating, transmitting, or receiving—potentially in cooperation with any of antenna(s) 730—communications signals according to any of the communications protocols discussed above including, but not limited to, one or more Wi-Fi and/or Wi-Fi direct protocols, as standardized by the IEEE 802.11 standards, one or more non-Wi-Fi protocols, or one or more cellular communications protocols or standards. The transceiver(s) 712 may further include hardware, firmware, or software for receiving GNSS signals. The transceiver(s) 712 may include any known receiver and baseband suitable for communicating via the communications protocols utilized by the computer system(s) 700. The transceiver(s) 712 may further include a low noise amplifier (LNA), additional signal amplifiers, an analog-to-digital (A/D) converter, one or more buffers, a digital baseband, or the like.

The sensor(s)/sensor interface(s) 710 may include or may be capable of interfacing with any suitable type of sensing device such as, for example, inertial sensors, force sensors, thermal sensors, photocells, and so forth. Example types of inertial sensors may include accelerometers (e.g., MEMS-based accelerometers), gyroscopes, and so forth.

The optional display(s) 714 may be configured to output light and/or render content. The optional speaker(s)/microphone(s) 716 may be any device configured to receive analog sound input or voice data.

It should be appreciated that the program module(s), applications, computer-executable instructions, code, or the like depicted in FIG. 7 as being stored in the data storage 720 are merely illustrative and not exhaustive and that processing described as being supported by any particular module may alternatively be distributed across multiple module(s) or performed by a different module. In addition, various program module(s), script(s), plug-in(s), Application Programming Interface(s) (API(s)), or any other suitable computer-executable code hosted locally on the computer system(s) 700, and/or hosted on other computing device(s) accessible via one or more networks, may be provided to support functionality provided by the program module(s), applications, or computer-executable code depicted in FIG. 7 and/or additional or alternate functionality. Further, functionality may be modularized differently such that processing described as being supported collectively by the collection of program module(s) depicted in FIG. 7 may be performed by a fewer or greater number of module(s), or functionality described as being supported by any particular module may be supported, at least in part, by another module. In addition, program module(s) that support the functionality described herein may form part of one or more Applications executable across any number of systems or devices in accordance with any suitable computing model such as, for example, a client-server model, a peer-to-peer model, and so forth. In addition, any of the functionality described as being supported by any of the program module(s) depicted in FIG. 7 may be implemented, at least partially, in hardware and/or firmware across any number of devices.

It should further be appreciated that the computer system(s) 700 may include alternate and/or additional hardware, software, or firmware components beyond those described or depicted without departing from the scope of the disclosure. More particularly, it should be appreciated that software, firmware, or hardware components depicted as forming part of the computer system(s) 700 are merely illustrative and that some components may not be present or additional components may be provided in various embodiments. While various illustrative program module(s) have been depicted and described as software module(s) stored in the data storage 720, it should be appreciated that functionality described as being supported by the program module(s) may be enabled by any combination of hardware, software, and/or firmware. It should further be appreciated that each of the above-mentioned module(s) may, in various embodiments, represent a logical partitioning of supported functionality. This logical partitioning is depicted for ease of explanation of the functionality and may not be representative of the structure of software, hardware, and/or firmware for implementing the functionality. Accordingly, it should be appreciated that functionality described as being provided by a particular module may, in various embodiments, be provided at least in part by one or more other module(s). Further, one or more depicted module(s) may not be present in certain embodiments, while in other embodiments, additional module(s) not depicted may be present and may support at least a portion of the described functionality and/or additional functionality. Moreover, while certain module(s) may be depicted and described as sub-module(s) of another module, in certain embodiments, such module(s) may be provided as independent module(s) or as sub-module(s) of other module(s).

Program module(s), applications, or the like disclosed herein may include one or more software components including, for example, software objects, methods, data structures, or the like. Each such software component may include computer-executable instructions that, responsive to execution, cause at least a portion of the functionality described herein (e.g., one or more operations of the illustrative methods described herein) to be performed.

A software component may be coded in any of a variety of programming languages. An illustrative programming language may be a lower-level programming language such as an assembly language associated with a particular hardware architecture and/or operating system platform. A software component comprising assembly language instructions may require conversion into executable machine code by an assembler prior to execution by the hardware architecture and/or platform.

Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, or a report writing language. In one or more example embodiments, a software component comprising instructions in one of the foregoing examples of programming languages may be executed directly by an operating system or other software component without having to be first transformed into another form.

A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution).

Software components may invoke or be invoked by other software components through any of a wide variety of mechanisms. Invoked or invoking software components may comprise other custom-developed application software, operating system functionality (e.g., device drivers, data storage (e.g., file management) routines, other common routines and services, etc.), or third-party software components (e.g., middleware, encryption, or other security software, database management software, file transfer or other network communication software, mathematical or statistical software, image processing software, and format translation software).

Software components associated with a particular solution or system may reside and be executed on a single platform or may be distributed across multiple platforms. The multiple platforms may be associated with more than one hardware vendor, underlying chip technology, or operating system. Furthermore, software components associated with a particular solution or system may be initially written in one or more programming languages, but may invoke software components written in another programming language.

Computer-executable program instructions may be loaded onto a special-purpose computer or other particular machine, a processor, or other programmable data processing apparatus to produce a particular machine, such that execution of the instructions on the computer, processor, or other programmable data processing apparatus causes one or more functions or operations specified in the flow diagrams to be performed. These computer program instructions may also be stored in a computer-readable storage medium (CRSM) that upon execution may direct a computer or other programmable data processing apparatus to function in a particular manner, such that the instructions stored in the computer-readable storage medium produce an article of manufacture including instruction means that implement one or more functions or operations specified in the flow diagrams. The computer program instructions may also be loaded onto a computer or other programmable data processing apparatus to cause a series of operational elements or steps to be performed on the computer or other programmable apparatus to produce a computer-implemented process.

Additional types of CRSM that may be present in any of the devices described herein may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile disc (DVD) or other optical storage, magnetic cassettes, magnetic tape, magnetic disk storage or other magnetic storage devices, or any other medium which can be used to store the information and which can be accessed. Combinations of any of the above are also included within the scope of CRSM. Alternatively, computer-readable communication media (CRCM) may include computer-readable instructions, program module(s), or other data transmitted within a data signal, such as a carrier wave, or other transmission. However, as used herein, CRSM does not include CRCM.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

That which is claimed is:

1. An item packing station configured to generate a custom-sized package with multiple items, the item packing station comprising:

a multi-item loading component configured to support the multiple items, the multi-item loading component comprising:

a first surface;

a second surface disposed at an angle with respect to the first surface;

a first sidewall configured to slide in a vertical direction from a raised position to a lowered position; and a second sidewall configured to slide in the vertical direction from the raised position to the lowered position;

an intake gutter portion configured to receive the multiple items from the multi-item loading component;

a pusher component configured to push the plurality of items off the multi-item loading component when the first sidewall and the second sidewall are in the lowered position; and a lifter component configured to lift a sheet of packaging material toward the intake gutter portion.

2. The item packing station of claim 1, wherein the lifter component is (i) configured to form the sheet of packaging material around the intake gutter portion, (ii) configured to move the sheet of packaging material laterally at a substantially same speed as the pusher component pushes the plurality of items, and (iii) comprises a suction portion configured to secure the sheet of packaging material to the lifter component.

3. The item packing station of claim 1, further comprising:

an overhead sensor configured to image the plurality of items;

a display; and a controller configured to:

determine a set of available package sizes; and select a package size from the set of available package sizes to be generated based at least in part on the image.

4. The item packing station of claim 1, wherein the multi-item loading component is a first multi-item loading component, the item packing station further comprising:

a conveyor configured to move a second multi-item loading component to a position adjacent to the intake gutter portion after the first multi-item loading component is empty.

5. A system for generating a custom-sized package having a plurality of items, the system comprising:

a multi-item loading component configured to support the plurality of items, the multi-item loading component comprising:

a first surface;

a second surface disposed at an angle with respect to the first surface;

a first sidewall configured to slide in a vertical direction from a raised position to a lowered position; and a second sidewall configured to slide in the vertical direction from the raised position to the lowered position; and a pusher component configured to push the plurality of items off the multi-item loading component when the first sidewall and the second sidewall are in the lowered position.

6. The system of claim 5, wherein the angle is an acute angle and the first surface and the second surface form a V-shaped configuration.

7. The system of claim 5, wherein the first surface has a first length that is shorter than a second length of the second surface.

8. The system of claim 5, further comprising:

a conveyor configured to move the multi-item loading component to a position adjacent to an intake gutter portion of a custom-sized package generation system.

9. The system of claim 8, further comprising:

a lifter component configured to lift a sheet of packaging material toward the intake gutter portion.

10. The system of claim 9, wherein the lifter component is configured to form the sheet of packaging material around the intake gutter portion.

11. The system of claim 9, wherein the lifter component is further configured to move the sheet of packaging material laterally at a substantially same speed as the pusher component pushes the plurality of items.

12. The system of claim 9, wherein the lifter component comprises a suction portion configured to secure the sheet of packaging material to the lifter component.

13. The system of claim 5, wherein the multi-item loading component is disposed at a front end of a custom-sized package generation system.

14. The system of claim 5, further comprising:

an overhead sensor configured to image the plurality of items;

a display; and a controller configured to:

determine a set of available package sizes; and select a package size from the set of available package sizes to be generated by a custom-sized package generation system based at least in part on the image.

15. The system of claim 14, wherein the controller is further configured to:

determine that the plurality of items is out of position; and cause presentation of a manual handling notification at the display.

16. A custom-sized package generation system comprising:

a multi-item loading component configured to support a plurality of items to be packaged in a custom-sized package, the multi-item loading component comprising:

a first surface;

a second surface disposed at an angle with respect to the first surface;

a first sidewall configured to slide in a vertical direction from a raised position to a lowered position; and a second sidewall configured to slide in the vertical direction from the raised position to the lowered position; and a pusher component configured to push the plurality of items off the multi-item loading component when the first sidewall and the second sidewall are in the lowered position.

17. The custom-sized package generation system of claim 16, further comprising:

a conveyor configured to move the multi-item loading component to a position adjacent to an intake gutter portion of the custom-sized package generation system.

18. The custom-sized package generation system of claim 17, further comprising:

a lifter component configured to lift a sheet of packaging material toward the intake gutter portion;

wherein the lifter component is configured to form the sheet of packaging material around the intake gutter portion.

19. The custom-sized package generation system of claim 18, wherein the lifter component is further configured to move the sheet of packaging material laterally at a substantially same speed as the pusher component pushes the plurality of items.

20. The custom-sized package generation system of claim 16, further comprising:

an overhead sensor configured to image the plurality of items;

a display; and a controller configured to:

determine a set of available package sizes; and select a package size from the set of available package sizes to be generated by a custom-sized package generation system based at least in part on the image.

* * * * *